US006647229B2

(12) United States Patent
Haraguchi et al.

(10) Patent No.: US 6,647,229 B2
(45) Date of Patent: Nov. 11, 2003

(54) IMAGE FORMING APPARATUS WITH FLEXIBLE CHARGING MEMBER FOR USE WITH SPHERICAL TONER

(75) Inventors: Manami Haraguchi, Kanagawa (JP); Katsuhiro Sakaizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/043,124

(22) Filed: Jan. 14, 2002

(65) Prior Publication Data

US 2002/0136567 A1 Sep. 26, 2002

(30) Foreign Application Priority Data

Jan. 15, 2001 (JP) ..... 2001-006393

(51) Int. Cl.[7] ..... G03G 15/02
(52) U.S. Cl. ..... 399/149; 399/176
(58) Field of Search ..... 361/225; 399/50, 399/89, 149, 150, 168, 174, 175, 176

(56) References Cited

U.S. PATENT DOCUMENTS 6,035,162 A * 3/2000 Chigono ..... 399/175
6,081,681 A 6/2000 Nagase et al. ..... 399/174
6,128,456 A 10/2000 Chigono et al. ..... 399/176
6,134,407 A 10/2000 Ishiyama et al. ..... 399/174
6,285,848 B1 * 9/2001 Aita et al. ..... 399/175

FOREIGN PATENT DOCUMENTS

JP 10-307454 11/1998 ..... G03G/15/02
JP 10/307455 11/1998 ..... G03G/15/02
JP 10/307459 11/1998 ..... G03G/15/02

* cited by examiner

*Primary Examiner*—Hoang Ngo
(74) *Attorney, Agent, or Firm*—Fitzpatrick, Cella, Harper & Scinto

(57) ABSTRACT

An object of the present invention is to provide an image forming apparatus that has an image bearing body, a flexible charging member constituting a nip portion together with the image bearing body, the nip portion being provided with conductive particles, and a developing member for developing an electrostatic image formed on the image bearing body, with use of a developing agent, wherein the developing agent has substantially spherical toner.

17 Claims, 4 Drawing Sheets

$$SF-1=\frac{(MXLNG)^2}{AREA}\times\frac{\pi}{4}\times 100$$

$$SF-2=\frac{(PERI)^2}{AREA}\times\frac{1}{4\pi}\times 100$$

IMAGE FORMING APPARATUS WITH FLEXIBLE CHARGING MEMBER FOR USE WITH SPHERICAL TONER

BACKGROUND OF THE INVENTION

1. Field of the Invention

The present invention relates to an image forming apparatus such as a copying machine, a printer or the like which has a charging member for charging an image bearing body such as an electrophotographic sensitive body, an electrostatic recording dielectric or the like to predetermined polarity and potential.

More particularly, the present invention relates to an image forming apparatus which adopts, as a charging means for the image bearing body, a contact charging means using charging accelerating particles.

2. Related Art

Conventionally, in an image forming apparatus such as a copying machine, a printer or the like, a latent image formed on an image bearing body such as an electrophotographic sensitive body, an electrostatic recording dielectric or the like is visualized by using a dry developing agent (developer) being granular materials. In recent years, to cope with downsizing, simplification, energy saving and environmental measures of the apparatus, it pays attention to an image forming apparatus which disuses a cleaning container and a waste toner container and can achieve ozoneless operation that generation of ozone due to electrical discharge is decreased and a cleanerless operation.

1. Ozoneless Charging Means

As a means for performing an ozoneless charging process to the image bearing body, a contact charging means using charging accelerating particles is disclosed in Japanese Patent Application Laid-Open Nos. 10-307454 to 10-307459, U.S. Pat. Nos. 6,134,407, 6,081,681 and 6,128,456, and the like.

In this contact charging means, the charging accelerating particles are interposed in a charging nip (charging area, charging part) which is the contact portion of at least both the image bearing body (hereinafter called a photosensitive drum) functioning as the body to be charged and a contact charging member (hereinafter called a charging roller) being generally a conductive/elastic roller caused to be in contact with the photosensitive drum, whereby a direct injection charging mechanism is more predominant than a discharge charging mechanism.

The charging accelerating particles are the conductive particles which aim to assist the charging. For example, various conductive particles, each having the particle diameter 0.1 mm to 5 mm and the volume resistance $1\times10^{12}$ Ω·cm or less, more desirably $1\times10^{10}$ Ω·cm or less, such as metal oxide particles (e.g., conductive zinc oxide), other conductive inorganic particles, compounds with organic materials, and the like can be used.

Since the charging accelerating particles exist, the charging roller can be in contact with the photosensitive drum in the charging nip with a speed difference and also be in contact with the photosensitive drum closely through the charging accelerating particles. That is, the charging accelerating particles existing in the charging nip compactly scrape the surface of the photosensitive drum, whereby a charge is directly injected into the photosensitive drum, then, in the charging of the photosensitive drum by the charging roller, the direct injection charging mechanism can be made predominant by the existence of the charging accelerating particles.

Therefore, it is possible to achieve with simple structure low-apply-voltage and ozoneless direct injection charging that high charging efficiency which could not be obtained in conventional roller charging and the like can be obtained, and the surface of the photosensitive drum provided with a charge injection layer can be charged, without using any discharge, to a potential approximately equal to a charging bias voltage applied to the charging roller. Such the direct injection charging is effective for the charging means which performs the direct injection charging process uniformly and ozonelessly to the image bearing body such as the electrophotographic sensitive body, the electrostatic recording dielectric or the like so that the image bearing body has predetermined polarity and potential, in an electrophotographic image forming apparatus and an electrostatic recording image forming apparatus.

The charging roller has a foamed body so that the charging accelerating particles may effectively exist in the charging nip. That is, the charging accelerating particles are maintained within the foams on the surface of the charging roller, whereby an opportunity that the charging roller comes into contact with the photosensitive drum is increased.

Such a charging system not using the discharge can prevent discharge products from being created, whereby abrasion of the photosensitive drum due to the discharge products can be prevented, and a lifetime of the photosensitive drum can be thus prolonged. Besides, as compared with a general charging system using AC voltage, the above charging system is effective for energy saving and cost reduction because the photosensitive drum can be charged by low DC voltage.

2. Cleanerless

The image forming apparatus of cleanerless system has the structure that the cleaning container and the waste toner container for eliminating from the surface of the photosensitive drum a developing agent (hereinafter called toner) slightly remaining on this surface after a developing-agent image was transferred from the photosensitive drum to a recording medium are disused, the transfer residual toner on the photosensitive drum is eliminated therefrom by "developing simultaneous cleaning" with a developing means, and the eliminated toner is then retrieved to the developing means and reused.

The developing simultaneous cleaning is the method that the toner slightly remaining on the photosensitive drum after the image was transferred is retrieved by a fog elimination bias (fog elimination potential difference Vback being the potential difference between the DC voltage applied to the developing means and the surface potential on the photosensitive drum) when developing is performed in next and following steps.

According to such a method, since the transfer residual toner is collected (retrieved) by the developing means and used for the developing in the next and following steps, the waste toner can be suppressed, and thus trouble for maintenance can be decreased. Besides, since the cleanerless system is adopted, an advantage in respect of space is great, whereby the image forming apparatus can be greatly downsized.

If the charging means of the photosensitive drum is the contact charging means, it is possible to cause the contact charging member being in contact with the photosensitive drum to once retrieve the transfer residual toner for charging polarity adjusting and then emit the retrieved toner again to the photosensitive drum so that the emitted toner is retrieved by the developing means.

Further, if the charging means of the photosensitive drum performs the direct injection charging process using the charging accelerating particles, it is possible to uniformly charge the photosensitive drum in the image forming apparatus of cleanerless type.

Concretely, the charging accelerating particles are mixed with the developing agent of the developing means. Then, at the developing portion, the charging accelerating particles are supplied from the developing means to the surface of the photosensitive drum together with the toner, and at the transferring portion, only the toner is mainly transferred to the recording medium, and the charging accelerating particles are supplied to the charging nip being the contact portion between the charging roller and the photosensitive drum. Thus, it is possible to uniformly charge the photosensitive drum by the injection charging in the image forming apparatus of cleanerless type.

As above, the structure to supply the charging accelerating particles from the developing means to the charging nip being the contact portion between the charging roller and the photosensitive drum is disclosed in Japanese Patent Application Laid-Open No. 10-307455 and the like.

Incidentally, if the image forming operation is performed by using the image forming apparatus of cleanerless type which adopts, as the charging means for the image bearing body, the contact charging means using the charging accelerating particles, following problems become remarkable as the number of sheets of printing increases.

(1) Defective Charging due to Toner Clogginess within Foams of Charging Roller

As the number of accumulated sheets of printing increases, defective charging occurs. Then, as the number of accumulated sheets of printing further increases, the defective charging becomes remarkable, whereby desired high-fineness image printing becomes impossible.

Besides, when the photosensitive drum is started from the state that it had stopped for a long time, or when the image forming apparatus is intermittently used, the defective charging is remarkable.

The inventor and the like of the present invention pursued the cause of such the defective charging, and found that the defective charging occurs because the toner clogs the foams on the surface of the charging roller being the contact charging member and thus the charging accelerating particles of a sufficient amount necessary for the charging are maintained in the charging nip.

Such the toner clogginess occurs when the transfer residual toner, which was not able to be transferred to the side of a recording medium by a transferring means when a printing operation is performed, on the photosensitive drum being the image bearing body reaches the charging nip and penetrates the foams on the surface of the charging roller. Since the toner which penetrated the foams is distorted and the shape thereof is uneven because it has inequalities on its surface, movement of the toner does not easily occur within the foam itself and between the linked foams, and the inequalities on the surface of the toner are caught by the foam and the foam wall. As above, since the toner does not flow in the foams, the foams which should originally hold the charging accelerating particles are filled with the toner fast if the printing operation continues, whereby the charging accelerating particles can not be held on the surface of the charging roller.

Moreover, in addition to the cause of the defective charging by the transfer residual toner, it was also clarified that the charging roller is filled with the toner when driving of the photosensitive drum starts. The reason why the toner is carried when the driving of the photosensitive drum starts is that a part of the toner existing in the portion (hereinafter called a developing nip) where the photosensitive drum is in contact with the developing roller of the developing means while the drum is stopping is adhered on the drum by surface adsorption force, the adhered toner is then moved to the charging nip by the rotation of the drum, and the moved toner thus reaches the charging roller. Since the toner almost loses the charge by leaving when the apparatus is stopping, such the toner can not be retrieved to the developing roller by using electrical action even if a potential difference is given between the photosensitive drum and the developing roller.

If a separation mechanism is provided between the photosensitive drum and the developing roller, the toner clogginess when the driving of the photosensitive drum starts can be prevented. However, in such a case, a problem that a complicated separation mechanism is necessary and thus it costs is newly caused.

A part of the uncharged toner which reached the charging nip passes this nip by the rotation of the photosensitive drum, but most of the residual toner penetrates the foams of the charging roller in the charging nip. Since the toner which penetrated the foams is distorted and the shape thereof is uneven because it has inequalities on its surface, movement of the toner does not easily occur within the foam itself and between the linked foams, and the inequalities on the surface of the toner are caught by the foam and the foam wall.

Conventionally, the toner of which the shape is uneven is used. For example, a resin, a pigment, a charging control agent and the like are kneaded by a mixing machine, and the kneaded matter is further crushed and sorted, whereby so-called crushed toner of which the shape is uneven can be obtained.

As above, since the toner does not flow in the foams, the foams which should originally hold the charging accelerating particles are filled with the toner fast if the printing operation continues, whereby the charging accelerating particles can not be held on the surface of the charging roller.

The reason why the defective charging becomes remarkable when the photosensitive drum is started from the state that the apparatus had stopped for a long time or when the apparatus is intermittently used is that the large amount of the uncharged toner which can not be electrically retrieved reaches the charging nip.

Further, if the charging roller is filled with the toner, hardness of the charging roller increases fast, whereby a problem that a torque increases and an excessive load is applied to the driving motor for the charging roller is caused.

In addition, if the contact pressure of the charging nip increases and thus frictional heat is caused excessively, a problem that the toner in the foams of the charging roller softens and is fused to the photosensitive drum and the charging roller is caused.

(2) Fog on Drum

In addition to the problem of the defective charging due to the toner clogginess within the foams of the charging roller, a following problem is caused.

That is, the problem that so-called "fog on drum" in which the toner is adhered on the photosensitive drum even if any latent image does not exist on the drum in the image forming operation occurs, whereby a transferring material is stained, and the toner causing the fog again reaches the charging nip to cause the defective charging as in the problem (1).

Like the problem (1), particularly, when the photosensitive drum is started from the state that it had stopped for a long time, or when the image forming apparatus is intermittently used, the fog on the photosensitive drum is remarkable.

The inventor of the present invention pursued the cause of such the fog on the drum, and found that the fog occurs because the uncharged toner and the inadequately charged toner exist on the photosensitive drum after it passed the charging nip. Conventionally, the toner of which the shape is uneven is used, and reversal toners such as the uncharged toner, the transfer residual toner and the like which reached the charging nip when the driving of the photosensitive drum starts are not mixed frictionally with the charging accelerating particles in the charging nip uniformly, whereby a charging amount of the toner becomes uneven, and the uncharged toner which is hardly charged and the reversal toner of which the surface is not uniformly charged and which passed the charging nip without sufficient regular charging exist. As a result, the toner adhered on the non-image portion can not be retrieved into the developing means by an electric field between the photosensitive drum and the developing roller, whereby the fog on the drum occurs.

The reason why the fog on the photosensitive drum becomes remarkable when the drum is started from the state that it had stopped for a long time or when the apparatus is intermittently used is that, as described above, the large amount of the uncharged toner reaches the charging roller.

SUMMARY OF THE INVENTION

An object of the present invention is to provide an image forming apparatus which prevents defective charging due to stagnation of toner on a charging member.

Another object of the present invention is to provide an image forming apparatus which can stably bear conductive particles on a charging member.

Still another object of the present invention is to provide an image forming apparatus which prevents hardness of a charging member from increasing.

Still another object of the present invention is to provide an image forming apparatus which prevents a fog of toner on an image bearing body.

Still another object of the present invention is to provide an image forming apparatus which can decrease uncharged toner and reversal toner.

Other objects and features of the present invention will become more apparent when reading the following detailed description with reference to the attached drawings.

DETAILED DESCRIPTION OF THE PREFERRED EMBODIMENTS

First Embodiment

Figure 1:
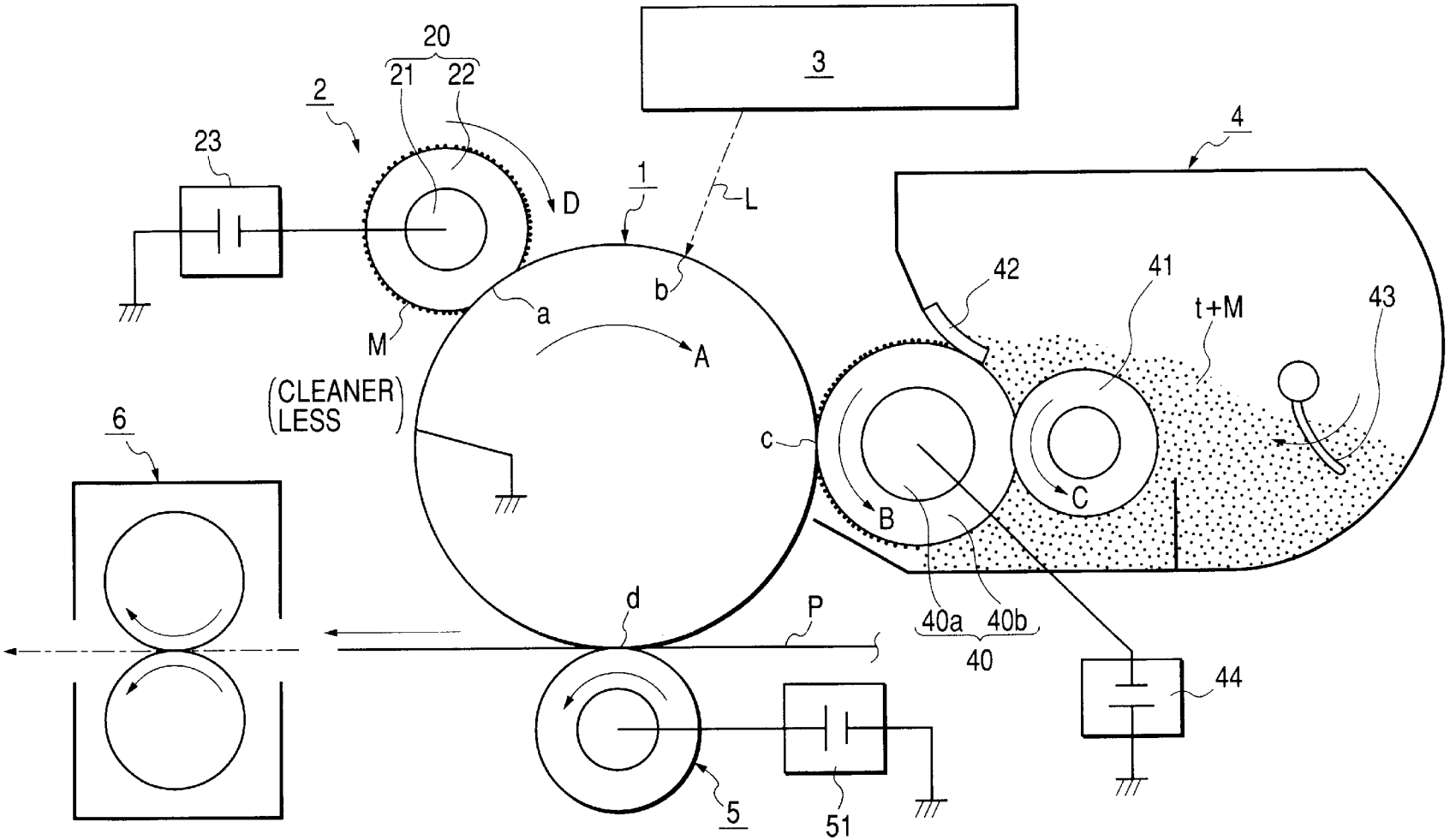
FIG. 1 is a schematic diagram showing an image forming apparatus according to the first embodiment.

FIG. 1 is a schematic diagram showing an image forming apparatus according to the present invention. The image forming apparatus in the present embodiment is a laser beam printer which adopts a transferring-system electrophotographic process, a contact charging system using charging accelerating particles, a reversal contact developing system of negative polarity and a cleanerless system.

(1) Outline of Entire Structure of Image Forming Apparatus

<1> Image Bearing Body

Figure 2:
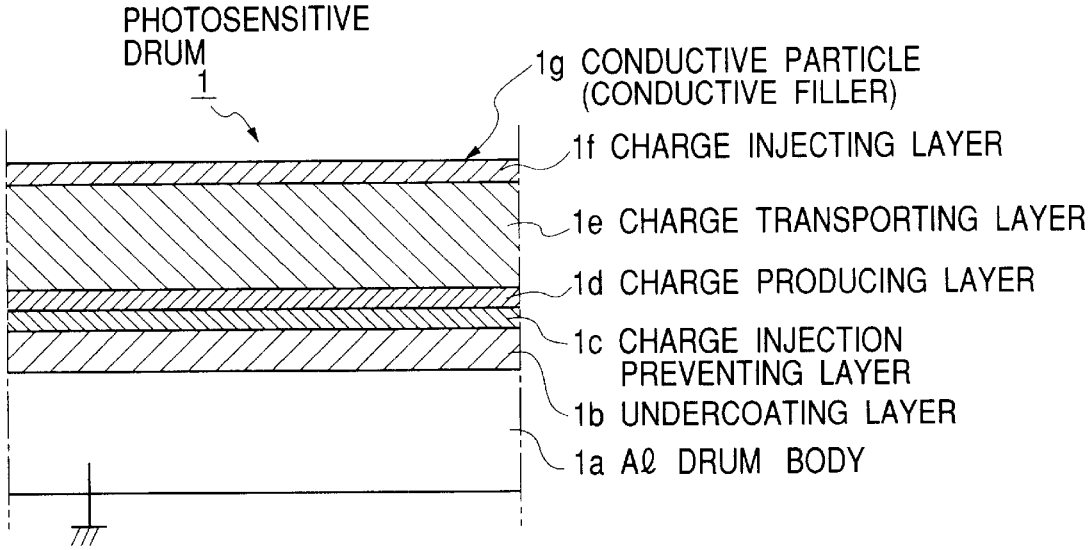
FIG. 2 is a model view showing a layer structure of a photosensitive drum.

Numeral 1 denotes a rotational-drum-type electrophotographic sensitive body (hereinafter called a photosensitive drum), having a diameter of 30 mm (Φ30 mm), which functions as an image bearing body. The image bearing body 1 is rotatively driven clockwise along an arrow A at a circular speed 100 mm/s. In the present embodiment, the photosensitive drum 1 having the layer structure as shown in FIG. 2 is used.

That is, a charge injecting layer if is coated on a general organic photosensitive body in which an undercoating layer 1*b*, a charge injection preventing layer 1*c*, a charge producing layer 1*d* and a charge transporting layer 1*e* are coated in due order on an aluminum drum body 1*a*. The charge injecting layer if is made by mixedly dispersing and coating $SnO_2$ microparticles (diameter is about 0.03 mm), a slip additive such as Teflon, a polymerization starting agent and the like functioning as a conductive particles 1*g*, on an acrylic resin of optical hardening type, and then performing membrane forming for the layer in an optical hardening method.

The photosensitive drum 1 functioning as the image bearing body used in the present invention can effectively accept charge by decreasing the resistance of the surface layer of the photosensitive drum, to inject the charge from a charging roller 20 as a later-described contact charging member to the surface layer of the drum. On the other hand, since it is necessary to hold an electrostatic latent image for a certain time, the volume resistance of the charge injecting layer if is appropriately within the range of $1\times10^{9}$ Ω·cm to $1\times10^{14}$ Ω·cm.

Further, even in a case where the charge injecting layer as in the present embodiment is not used, the same effect as above can be obtained, for example, if the resistance of the charge transporting layer 1*e* is within the above resistance range. Furthermore, the same effect as above can be obtained if an amorphous silicon photosensitive body or the like of which the surface layer volume resistance is about $10^{13}$ Ω·cm is used.

<2> Charging

Numeral 2 denotes a direct injection charger which has the foamed elastic charging roller 20 disposed to come into contact with the photosensitive drum 1, charging accelerating particles M of weak positive polarity existing at least between the photosensitive drum 1 and the charging roller 20, and a DC high voltage power supply 23 for applying a charging bias voltage to the charging roller 20.

The charging roller 20, in which an elastic foamed layer 22 having conductivity is disposed around a conductive core 21, is caused to be in contact with the photosensitive drum 1 by pressing force of total 9.8N (1 kgf) or so, and the contact portion between the charging roller 20 and the photosensitive drum 1 functions as a charging nip a.

The charging roller 20 is rotatively driven clockwise along an arrow D at a circular speed 150 mm/s to rotate in the direction opposite to the rotational direction of the photosensitive drum 1 at the charging nip a. That is, the charging roller 20 comes into contact with the photosensitive drum 1 with a speed difference to scrape the surface of the drum 1. Then, in the present embodiment, a DC voltage of −500V is applied from the DC high voltage power supply 23 to the charging roller 20, whereby the surface of the photosensitive drum is directly charged, through the charging accelerating particles M, to about −500V uniformly in an injection charging system without using any charging.

The structures of the charging roller 20 and the charging accelerating particles M will be explained in detail in later-described paragraphs (2) and (3) respectively.

<3> Exposing

Numeral 3 denotes an exposing device which functions as an optical image exposing means. In the present embodiment, a laser scanner being the exposing device outputs a laser beam L modified in correspondence with a time-series electrical digital pixel signal of image information to scan and expose an exposing portion b on the surface of the uniformly charged photosensitive drum 1. Thus, the potential of the laser-irradiated portion on the uniformly charged surface of the photosensitive drum 1 is attenuated, whereby the electrostatic latent image of the image information is formed. A laser-nonirradiated portion corresponds to a non-image portion, and the laser-irradiated portion corresponds to an image portion. The potential of the non-image portion is −500V, and the potential of the image portion is −150V.

<4> Developing

Numeral 4 denotes a developing device which functions as a developing means. The developing device 4 in the present embodiment adopts a reversal developing system and a contact developing system to adhere a non-magnetic negative-charging one-component developing agent (toner) to the image portion (laser-irradiated portion) of the electrostatic latent image formed on the photosensitive drum 1 to visualize the toner-adhered portion.

As described in the related art, the contact developing system which causes a developing agent bearing body to abut against an image bearing body and applies a DC voltage to the developing agent bearing body to form a developing electric field is significantly effective as the technique to disuse a cleaning container and a waste toner container.

The developing device 4 has an opening extending in its longitudinal direction, and an elastic developing roller 40 is disposed at the opening as a developing member (developing agent bearing body) arranged to come into pressure contact with the photosensitive drum 1. The developing roller 40 is always in contact with the photosensitive drum 1, and its contact portion functions as a developing nip (developing area, developing part) c. The developing roller 40 is rotatively driven counterclockwise along an arrow B at a circular speed 150 mm/s. Further, a feeding roller 41 which is disposed to come into contact with the developing roller 40 and rotatively driven counterclockwise along an arrow C, and a regulating blade 42 which is positioned above the feeding roller 41 in the vertical direction and disposed to come into contact in pressure with the elastic developing roller 40 are arranged in the developing device 4, and a mixture of toner t and the charging accelerating particles M is also contained in the developing device 4. Numeral 43 denotes an agitating member in the developing device.

The feeding roller 41 functions to supply the toner onto the developing roller 40 and remove or scrape the toner from the developing roller 40. The regulating blade 42 used as a regulating member functions to give a desired amount of charging to the developing roller and regulate an amount of toner. Further, a DC high voltage power supply 44 which applies a developing bias voltage to the elastic developing roller 40 is provided.

The feeding roller 41 rotates along the arrow C to carry the toner including the charging accelerating particles M onto the surface of the developing roller 40 rotating along the arrow B. When the toner t and the charging accelerating particles M carried by the developing roller 40 pass between the regulating blade 42 disposed to come into contact in pressure with the developing roller 40 and the developing roller 40 itself, the toner t is charged to negative polarity by the friction between the regulating blade 42 and the developing roller 40, and the charging accelerating particles M are charged to weak positive polarity. At the same time, the layer thickness of the toner is regulated.

By the electric field created from the developing bias voltage and the potential on the photosensitive drum 1, the toner charged in the vicinity of the developing nip c being the contact portion between the photosensitive drum 1 and the developing roller 40 is adhered to the image portion of the electrostatic latent image on the photosensitive drum 1 to visualize the latent image.

At this time, the charging accelerating particles M are supplied onto the photosensitive drum 1 as adhering to the toner t at the image portion on the photosensitive drum 1, and also, at the non-image portion on the drum 1, the charging accelerating particles M charged to weak positive polarity are supplied onto the drum 1 by the developing electric field.

On the other hand, the residual toner t and the residual charging accelerating particles M, on the developing roller 40, which were not consumed in the developing nip c when the electrostatic latent image was developed on the photosensitive drum 1 are returned into the developing device 4 by the continuous rotation of the developing roller 40. Then, the residual toner t and the charging accelerating particles M on the developing roller 40 are removed at the contact portion between the developing roller 40 and the feeding roller 41 by the scrape between the developing roller 40 and the feeding roller 41, and thus retrieved into the developing device 4. At the same time, new toner is supplied onto the developing roller 40 by the rotation of the feeding roller 41, and again carried to the contact portion between the regulating blade 42 and the developing roller 40.

The above developing roller 40 and the toner t will be explained in detail in later-described paragraphs (4) and (5) respectively.

<5> Transferring

Numeral 5 denotes a transferring device (roller) which functions as a transferring means. In the present embodiment, the elastic transferring roller which is caused to be in contact with the photosensitive drum 1 to form a transferring nip (transferring area, transferring part) d is used. The transferring roller 5 is rotated in the same direction as the rotational direction of the photosensitive drum 1 at the circular speed approximately the same as that of the drum 1. Then, a transferring material P such as paper, an OHP sheet or the like being the recording medium is fed from a not-shown sheet feeding portion to the transferring nip d at predetermined control timing, and the fed transferring material P is nipped and conveyed in the transferring nip d. While the transferring material P is being nipped and conveyed in the transferring nip d, a predetermined transferring bias voltage is applied from a DC high voltage power supply 51 to the transferring roller 5. The transferring bias voltage is the DC voltage having the polarity opposite to the charging polarity of the toner t. In the present embodiment, since the charging polarity of the toner t is negative, the positive-polarity transferring bias voltage is applied to the transferring roller 5.

Thus, the toner images on the side of the photosensitive drum 1 are electrostatically transferred sequentially to the surface of the transferring material P nipped and conveyed in the transferring nip d.

<6> Fixing

The transferring material P passed the transferring nip d is sequentially separated from the surface of the photosensitive drum 1, introduced into a fixing device 6, subjected to a toner image fixing process, and then discharged as an image-formed matter (copy, print). Generally, the fixing device 6 adopts a thermal fixing system to melt and fix the toner image.

<7> Cleanerless

The transfer residual toner remains slightly on the photosensitive drum 1 after the transferring material was separated therefrom, and such the transfer residual toner is charged to weak positive polarity because it suffers the transferring bias voltage.

The image forming apparatus in the present embodiment adopts the cleanerless system not having any dedicated cleaner, and disuses the cleaning container and the waste toner container used to eliminate the transfer residual toner from the surface of the photosensitive drum 1, whereby the residual toner is carried to the charging nip a by the continuous rotation of the drum 1. If the transfer residual toner reaches the charging nip a, the toner reached is returned to negative polarity as it is mixed frictionally with the charging accelerating particles M, and then carried to the developing nip c by the further rotation of the of the drum 1.

Figure 3:
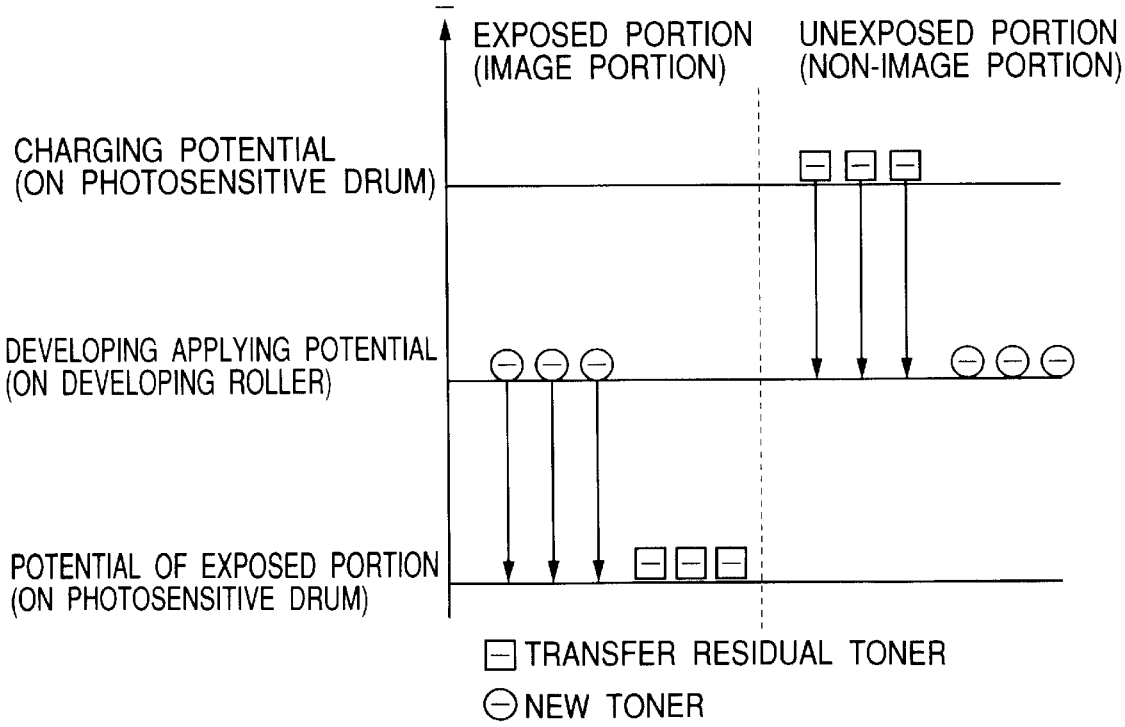
FIG. 3 is a view for explaining developing simultaneous cleaning.

The management of the transfer residual toner carried to the developing nip c is different according to presence/absence of a latent image on the photosensitive drum 1 in a next image forming step. This will be explained in FIG. 3. The transfer residual toner existing on the image portion (exposed portion) of the photosensitive drum is used, also in the next developing step, to visualize the latent image together with the toner on the developing roller 40 by the electric field for applying the toner from the developing roller 40 to the photosensitive drum 1. On the other hand, the transfer residual toner existing on the non-image portion (unexposed portion) of the photosensitive drum is retrieved to the developing roller 40 by the electric field for applying the toner from the photosensitive drum 1 to the developing roller 40 (developing simultaneous cleaning).

Here, the "contact developing" system which causes the developing agent bearing body 40 to come into contact with the image bearing body 1 and applies the DC voltage to the developing agent bearing body 40 to form the developing electric field is significantly effective in the developing device 4 to disuse the cleaning container and the waste toner container. This is because, by the developing electric field created between the image bearing body 1 and the developing agent bearing body 40, the "contact developing" system can retrieve the toner remaining on the image bearing body after the transferring operation and reuse for the developing agent bearing body as performing the developing operation in the next developing step.

As a developing system other than the above contact developing system, there is a "noncontact developing (jumping developing)" system that the developing agent bearing body is not in contact with the image bearing body. However, in this system, since the management of the toner is controlled between the gap (about hundreds of mm) between the developing agent bearing body and the image bearing body, it is necessary to apply to the developing agent bearing body a high-voltage developing bias obtained by superposing AC and DC voltages, whereby the toner can not be easily retrieved from the photosensitive drum completely because the toner travels in the developing nip. Thus, since dirt on the transferring material due to adhesion of the toner to the non-image portion (so-called AC fog) occurs easily in the noncontact developing system, it is desirable to adopt the contact developing system as the technique to disuse the cleaning container and the waste toner container. Moreover, scatter of the toner due to the traveling of the toner in the gap occurs easily in the noncontact developing system, whereby there is a problem that the dirt on the transferring material and the dirt inside the apparatus occur easily.

<8> Supply of Charging Accelerating Particles M From Developing Device 4 to Charging Nip a On the other hand, although the charging accelerating particles M of weak positive polarity which were adhered from the side of the developing roller 40 onto the surface of the photosensitive drum 1 in the developing step of the electrostatic latent image on the photosensitive drum 1 are not actively transferred to the transferring material P in the transferring nip d by the electric field, these particles are physically adheres slightly due to inequalities and adhesion on the surface of the transferring material P. However, the majority of the charging accelerating particles M remaining on the photosensitive drum 1 after passing the transferring nip are carried and supplied to the charging nip a by the continuous rotation of the photosensitive drum 1, and the supplied particles reaches M are used to charge the surface of the photosensitive drum 1.

The surplus charging accelerating particles M which were not able to be held by the charging roller 20 are still adhered to the photosensitive drum 1. After such the particles M passed the charging nip a and the exposing portion b, they are carried to the developing nip c. The carried charging accelerating particles M are retrieved in the developing nip c by the developing device 4 at the portion corresponding to the image portion on the photosensitive drum 1. On the other hand, the carried charging accelerating particles M again pass the developing nip c and the transferring nip d at the portion corresponding to the non-image portion on the photosensitive drum 1, and then the particles M are repeatedly carried to the charging nip a.

In the present embodiment, the charging roller 20 is coated with the charging accelerating particles M of a proper amount beforehand, and, for regular replenishment, as described above, the charging accelerating particles M are mixed with the toner t in the developing device 4 and then supplied therefrom when the image forming operation is performed. Since the charging accelerating particles M have weak positive polarity, they are electrostatically applied to the non-image portion where any toner image is not formed, and carried to the charging nip a by the rotation of the photosensitive drum 1.

(2) Charging Roller 20

In the present embodiment, an elastic roller of which the diameter is 12 mm and Asker-C hardness (by KOBUNSHI KEIKI Co.,Ltd.) is 30 degrees and in which the elastic foamed layer 22 is disposed around the conductive core 21 such as a stainless core or the like of which the diameter is 6 mm is used. The average foam diameter of the charging roller 20 is about 70 mm, and the width of the charging nip a is about 3.5 mm. The elastic foamed layer 22 is manufactured by heating, vulcanizing and foaming a polyurethane rubber layer on which a foaming agent and a conductive-material compound agent such as carbon black or the like have been uniformly distributed, and then grinding the surface of the layer according to necessary.

Since it is important that the charging roller 20 functions as an electrode to charge the photosensitive drum 1, it is necessary for the roller 20 to have a sufficiently low resistance, meanwhile, it is necessary to prevent a leak of the voltage if a defect part such as a pinhole or the like exists on the photosensitive drum 1. Thus, as the resistance satisfying both the cases, $10^4$ Ω to $10^7$ Ω are suitable in the following measuring method.

In such the measuring method, the charging roller 20 is come into pressure-contact with an aluminum drum of which the diameter (30 mm in the present embodiment) is the same as that of the used photosensitive drum 1 so that the load (total pressure 1 kg in the present embodiment) applied to the charging roller 20 when the image is formed is applied. Then, the aluminum drum is rotated at 100 mm/s, the charging roller 20 is rotated counter (in the charging nip) at 150 mm/s, a voltage of 100V is applied to the charging roller 20, and the resistance between the charging roller and the aluminum drum is set to the resistance. The resistance of the charging roller used in the present embodiment is $10^6$ Ω.

Further, it is necessary to obtain the sufficient contact state between the charging roller 20 and the photosensitive drum 1 to charge the surface of the drum 1. To obtain the sufficient contact state, it is desirable to made the contact portion of the roller 20 with the drum 1 by an elastic body such as a rubber layer, a foamed body layer or the like. However, if the hardness is too low, the shape of the charging roller is not steady, and a certain contact condition can not always be obtained, whereby differences in chargeability may occur, and permanent deformation may occur when the charging roller is in the stop state for a long time. On the other hand, if the hardness is too high, the charging nip can not be sufficiently secured, whereby sufficient chargeability may not be obtained, and loads to be applied to the photosensitive drum and the toner may increase because a torque increases. For these reasons, the elastic body of which Asker-C hardness is 25 to 50 degrees is desirable.

Further, it is desirable for the charging roller to have inequalities on its surface to maintain the charging accelerating particles M of enough amount. The charging roller which has the foams on its surface as in the present embodiment is exceedingly desirable. Moreover, by manufacturing the roller with the foamed body having foams, the hardness of the roller can be easily decreased. If the charging roller 20 is manufactured by the foamed body having foams, at least the average foam diameter on the surface of the charging roller is set to be three times or more, more desirably five times or more, a toner weight average particle diameter of the toner. By setting such the average foam diameter, the toner penetrated the foams can relatively freely move and rotate within the foams, and then the toner is smoothly and surely emitted outside the foams by elastic deformation of the charging roller. On the contrary, if the average foam diameter is equal to the toner average particle diameter to less than three times the toner average particle diameter, the foams are easily infilled most closely with the penetrated toner, whereby there is a fear that the toner can not easily move and rotate in the foams.

Incidentally, the average foam diameter of the charging roller 20 is measured in the following measuring method. That is, the area of a maximum foamed cell is measured from the enlarged image of an arbitrary section of the charging roller 20, and the diameter corresponding a true circle is calculated from the measured area. After the foam diameter being ½ or less such the maximum foam diameter was deleted as a noise, the foam diameters are averaged from the remaining foamed cell areas, whereby the average foam diameter can be obtained.

In the present embodiment, with respect to the toner weight average particle diameter 7 mm, the charging roller 20 of which the average foam diameter is 70 mm is used.

The material of the charging roller 20 is not specially specified. That is, the material which is obtained by distributing a conductive material such as carbon black, metal oxide or the like on a generally used rubber such as EPDM (ethylene-propylene diene terpolymer), urethane, NBR (acrylonitrile-butadiene rubber), silicone rubber, IR (isoprene rubber) or the like can be used. Incidentally, an ion-conductive elastic body layer may be used without especially distributing the conductive material.

In the present embodiment, although the elastic foamed body having the foams on the surface of the roller is used to apply the sufficient charging accelerating particles M to the charging nip a, an unfoamed elastic body or a brushy body may be used if such the body has inequalities capable of holding and maintaining the charging accelerating particles on the surface of the roller. Moreover, a multilayered structure where its outermost layer is a foamed elastic body and its lower layer is a low-hardness solid rubber elastic body may be used.

Further, it is desirable that the charging roller 20 is rotated at the contact portion with the photosensitive drum 1 with a speed difference, and the moving direction of the circumferential surface of the charging roller is made opposite to the moving direction of the circumferential surface of the photosensitive drum at the contact portion with the photosensitive drum. This is because it is necessary to sufficiently secure a contact chance between the photosensitive drum 1 and the charging roller 20 to uniformly charge the drum 1 in the little and narrow charging nip a. Further, in the case where the charging roller is manufactured by the foamed elastic body as in the present embodiment, if the moving direction of the circumferential surface of the charging roller is made opposite to the moving direction of the circumferential surface of the photosensitive drum at the contact portion with the photosensitive drum, it becomes easy to emit the toner in the foams from the charging roller as compared with a case where the circumferential surface of the charging roller is moved forward.

Figure 4:
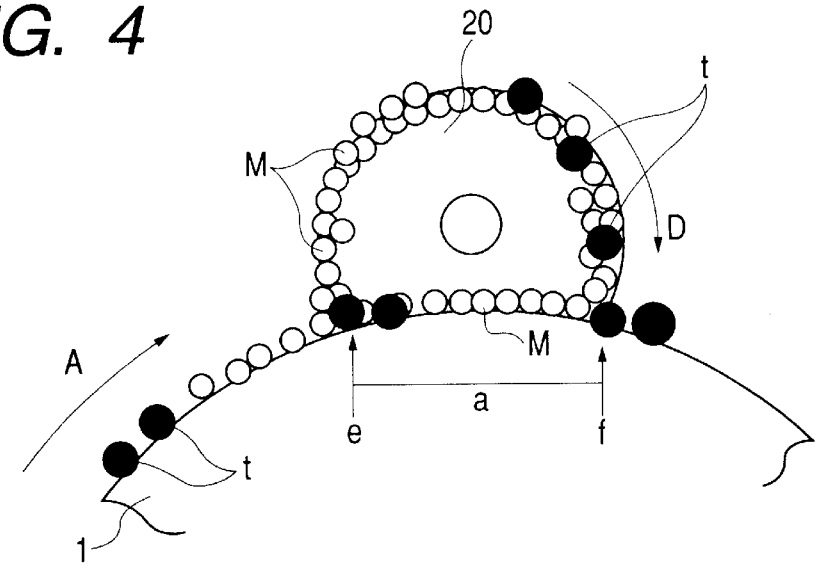
FIG. 4 is a model view for explaining toner retrieval and emission of a charging roller.

That is, as shown in FIG. 4, if the transfer residual toner t on the photosensitive drum 1 is entered a charging nip entrance e of the charging nip a by the rotation of the photosensitive drum 1, the majority of the entered toner t is charged to negative polarity as suffering friction with the charging accelerating particles M at the charging nip entrance e, then carried to the inequalities of the foams on the surface of the charging roller, rounded around the charging roller 20, and thus carried to a charging nip downstream portion f. Thus, if the toner is rounded around the charging roller, it becomes difficult for the toner to penetrate the charging nip, and there is an effect of preventing defective charging.

If the toner reaches the charging nip downstream portion f, then the toner in the foams of the charging roller is easily pushed out to the surface of the drum from the foams by elastic deformation of the charging roller 20 and carried to the developing device by the drum rotation, whereby the toner can be retrieved by the charging roller.

(3) Charging Accelerating Particles M

Since the charging accelerating particles M are applied to the charging nip a, even if a few toner adheres to the charging roller 20, it is possible to maintain close contact of the charging roller 20 with the photosensitive drum 1 and, at the same time, uniformly charge the surface of the photosensitive drum 1 without using any discharge.

Further, since the charging accelerating particles M are mixed frictionally with the toner t in the charging nip a, it is possible to regularly charge the toner t on the photosensitive drum 1. Moreover, since the charging accelerating particles M exist in the charging nip a, even if the rotational directions and the speeds of the photosensitive drum 1 and the charging roller 20 are different, it is possible to rotate them with low torque because the charging accelerating particles M function like rollers.

In the present embodiment, as the charging accelerating particles M to be coated on the charging roller 20 beforehand and the charging accelerating particles M to be mixed with the toner t within the developing device 4, zinc oxide particles of which the resistivity is $10^7$ (Ω·cm) and the average particle diameter is 1.5 mm are used.

The particle diameter is determined by extracting the hundred or more particles according to the observation with an optical microscope or an electron microscope, calculating a volume particle size distribution with a maximum string length in the horizontal direction, and obtaining its 50% average particle diameter.

The particle diameter range of the charging accelerating particles M in the present invention is desirably 50 mm or less to obtain excellent uniformity, and more preferably equal to the size of a constitution pixel or less to prevent light scattering by the charging accelerating particles M when the exposing is performed.

Although the charging accelerating particles M may exist not only in the state of primary particles but also in the state of the aggregate of secondary particles, there is no problem especially. Incidentally, when the particles are aggregated, the particle diameter is defined by the average particle diameter as such the aggregate.

The resistance is measured and normalized by a pellet method. That is, the powder (particle) sample of about 0.5 g is put in a cylinder of bottom area 2.26 $cm^2$, and its resistance is measured by applying a pressure of 15 kg and simultaneously applying a voltage of 100V to the upper and lower electrodes of the cylinder, and then the resistivity is measured by normalizing the measured resistance.

The appropriate range of the resistance of the charging accelerating particles M in the present invention is necessarily $10^{12}$ (Ω·cm) or less, and more preferably $10^{10}$ (Ω·cm) or less, to secure sufficient chargeability.

Further, even if the toner t adheres to the charging roller 20, the applying amount of the charging accelerating particles M in the charging nip a is desirably 1000 particles/$mm^2$ or more, more preferably 1000 to 500000 particles/$mm^2$, to maintain the close contact of the charging roller 20 with the photosensitive drum 1. If the applying amount of the charging accelerating particles M is 500000 particles/$mm^2$ or more, exposing scattering by the charging accelerating particles M easily occurs, whereby there is a fear that a lack of exposing amount occurs.

In the present embodiment, the applying amount of the charging accelerating particles M is adjusted by setting a composition amount of the charging accelerating particles M to be mixed in the developing device 4. Generally, the charging accelerating particles are within the range of 0.01 to 20 parts by weight for the toner of 100 parts by weight.

In the present embodiment, the charging accelerating particles are set to 3 parts by weight for the toner of 100 parts by weight, and the applying amount of the charging accelerating particles is set to about 50000 to 80000 particles/$mm^2$.

To measure the applying amount of the charging accelerating particles M, it is desirable to count the number of the particles existing in the charging nip a. However, since the majority of the charging accelerating particles M on the photosensitive drum 1 before the drum comes into contact with the charging roller 20 are scraped off by the charging roller 20 in the charging nip a, the number of the particles on the surface of the charging roller immediately before the charging roller reaches the charging nip a is set as the applying amount. Concretely, the rotations of the photosensitive drum 1 and the charging roller 20 are stopped in the state that the charging bias voltage is not applied, the surfaces of the photosensitive drum 1 and the charging roller 20 are taken by a video microscope and a digital still recorder, and then the number of the particles is counted according to image processing software by using the taken image.

Further, transparent particles or white particles are appropriate as the charging accelerating particles M so that the particles do not disturb the exposing. Moreover, the transparent particles or the white particles are also appropriate in consideration of the case where the part of the charging accelerating particles M on the photosensitive drum 1 adheres to the transferring material P when the image is transferred.

In the present embodiment, zinc oxide is used for the charging accelerating particles M by way of example. However, the material of the particles is not limited to this, i.e., other metal-oxide conductive inorganic particles such as alumina, etc., compounds with organic materials, these materials subjected to surface treatment, and the like can be used. Particularly, the metal oxide can be easily used because it is easily charged to weak positive polarity and is often whitish.

(4) Developing Roller 40

In the present embodiment, an elastic roller of which the entire diameter is 16 mm and in which an elastic body layer 40*b* is disposed around a conductive core 40*a* such as a stainless core or the like of diameter 8 mm is used as the developing roller 40 of the developing device 4. The elastic body layer 40*b* has the two-layer structure which includes a silicone rubber, on which carbon black is dispersed, as the lower layer and a polyamide resin of about 10 mm as the surface layer. The elastic body layer 40*b* has Asker-C hardness of about 35 degrees and a coefficient M of kinetic friction of about 0.1. Further, the width of the developing nip c is 2 mm.

As the hardness of the developing roller 40, Asker-C hardness of 25 to 50 degrees is appropriate. This is because, if the hardness is too low, the shape of the developing roller 40 is not steady, and thus the certain contact condition can not always be obtained, whereby the toner carrying amount becomes uneven, on the other hand, if the hardness is too high, the developing nip c can not sufficiently be secured, and toner deterioration in the developing nip c is promoted.

The surface roughness of the developing roller 40 is correlated with the particle diameter of the used toner, and ten-point average roughness Rz is desirably 3 mm to 15 mm when the weight average particle diameter of the toner is about 7 mm. If the ten-point average roughness Rz is 3 mm or less, the sufficient toner carrying force can not be obtained, while if the roughness Rz is 15 mm or more, the inequalities on the developing roller 40 may influence the image quality when the latent image on the photosensitive drum 1 is visualized as a toner image.

The elastic body layer 40*b* need not be limited to the two-layer structure, but may adopt a single-layer structure or a structure of three or more layers. Further, like the charging roller 20, the material of the elastic body layer 40*b* is not limited particularly, but may adopt generally used rubber or resin.

The resistance of the developing roller is appropriately $10^6$ Ω or more, more preferably $10^8$ Ω or more, according to the following measuring method. The reason why the resistance is set to $10^6$ Ω or more is to avoid danger of re-charging in the developing nip c when the amount of the residual toner becomes a few.

In such the measuring method, the charging roller is come into pressure-contact with an aluminum drum of which the diameter (30 mm in the present embodiment) is the same as that of the used photosensitive drum 1 so that the load (total pressure 14.7N (1.5 kgf) in the present embodiment) applied to the developing roller 40 when the image is formed is applied. Then, in the condition same as that in case of forming the image, i.e., the aluminum drum is rotated at 100 mm/s, the developing roller 40 is rotated forward (in the charging nip) at 150 mm/s, and a voltage of −350V is applied to the developing roller 40, whereby the resistance between the developing roller and the aluminum drum is set to the resistance.

(5) Toner t

This is the most important item in the present invention. It is necessary for the toner t to have a uniform shape, i.e., a spherical shape or a substantially spherical shape.

Since the toner shape is spherical, even if the toner t penetrates the charging roller 20 in the charging nip a, the penetrated toner can smoothly move in the foams and between the foams. The toner penetrated the foams can be easily pushed out of the foams by elastic deformation of the charging roller 20 in the charging nip a, whereby it is possible to prevent that the toner is packed in the foams. As a result, the sufficient amount of the charging accelerating particles M on the photosensitive drum 1 supplied from the developing device 4 can be held and maintained in the foams. Moreover, since the hardness change due to the toner packing is not caused, the torque change of the charging roller and the toner fusing as mentioned in the related art can be prevented.

Further, since the spherical toner rolls very easily because of its shape, the toner is mixed frictionally with the charging accelerating particles M in the charging nip a as it rolls, whereby it can be uniformly charged to negative polarity. As a result, if the toner on the photosensitive drum 1 passed the charging nip a reaches the developing area, it follows the electric field formed between the photosensitive drum 1 and the developing roller 40. Thus, the toner can move onto the photosensitive drum 1 if a latent image exists, while the toner can move to the side of the developing roller 40 if any latent image does not exist.

In addition to the above effect, it is possible by using the spherical toner having the uniform shape to make transferring efficiency almost 100%, and also to decrease the absolute amount of the transfer residual toner reached the charging nip a.

Further, even if a large amount of uncharged toner reaches the charging nip a immediately after driving of the photosensitive drum started, the foams of the charging roller are not clogged with the toner by performing preliminary rotating for a predetermined time, whereby the uncharged toner can be charged to negative polarity and then returned to the developing device 4. As a result, the developing simultaneous cleaning can be surely performed for a long time.

In the present invention, symbols SF-1 and SF-2 are used as shape factors representing the sphericity of the toner. The shape factor SF-1 represents a degree of round, i.e., SF-1 is 100 in case of complete sphericity. As the value of the factor SF-1 increases, the sphericity becomes unsteady. The shape factor SF-2 represents a degree of inequality, i.e., SF-2 is 100 in case of complete sphericity. As the value of the factor SF-2 increases, the inequalities on the toner surface become remarkable.

Based on the later-described experimental results, the values of the shape factors SF-1 and SF-2 suitable for the present invention are SF-1=100 to 160 and SF-2=100 to 140, and more desirably SF-1=100 to 140 and SF-2=100 to 120.

Since easiness of toner clogginess is remarkably influenced by the degree of inequality on the toner surface rather than the degree of round of the toner, it is desirable to set the value of (SF-2)/(SF-1) to 1.0 or less as satisfying the above condition.

Figure 5:
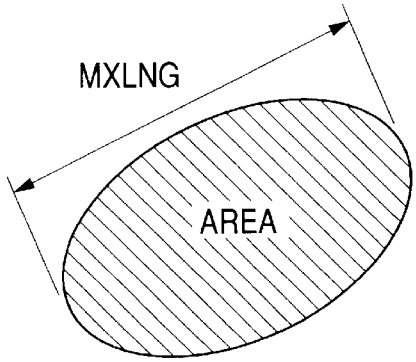
FIG. 5 is a view for explaining a toner shape factor SF-1.
Figure 6:
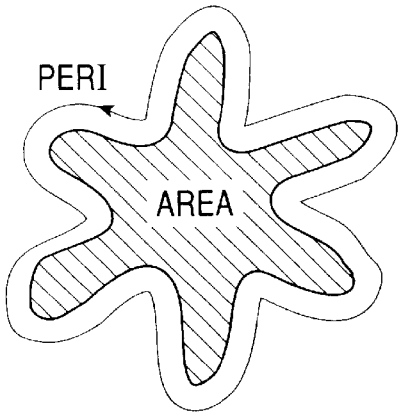
FIG. 6 is a view for explaining a toner shape factor SF-2.

The values of the factors SF-1 and SF-2 are obtained as follows. That is, 100 toner images each enlarged to 500 times in magnifying power are sampled at random by using an FE-SEM (field emission scanning electron microscope) (S-800) made by Hitachi, Ltd., the image information obtained based on the sampled images is introduced and analyzed in an image analyzing device (LUZEX3) made by Nicolet Japan Corporation through an interface, and then the values are obtained based on the analyzed results by using following expressions (see FIGS. 5 and 6).

$$SF\text{-}1=\{(MXLNG)^2/\mathrm{AREA}\}\times(\pi/4)\times 100$$

$$SF\text{-}2=\{(PERI)^2/\mathrm{AREA}\}\times(1/4\pi)\times 100$$

where AREA is a toner projection area, MXLNG is an absolute maximum length, and PERI is a peripheral length.

Further, a variation coefficient (A) in a distribution of the number is desirably 35% or less to apply uniform charges to the toner and thus obtain higher transferring efficiency. Here, the variation coefficient (A) is shown by a following expression.

$$(A)=(S/D\mathbf{1})\times 100$$

where S is a standard deviation in the distribution of the number of the toner, and D1 is a number average particle diameter of the toner particles (mm).

Further, the toner particle diameter is desirably 10 mm or less in a weight average particle diameter, more preferably 4 mm to 8 mm in the weight average particle diameter, to faithfully develop fine dots for the purpose of achieving high quality.

The distribution of the number is measured by using Coulter Counter Type TA II made by Coulter Inc. There are various methods of manufacturing the spherical toner as above. For example, a method using a polymerization reaction such as an emulsion polymerization method, a suspension polymerization method, a dispersion polymerization method or the like is frequently used. In addition to the polymerization method, there is a method of making crushed toner spherical as dissolving it by a solvent, that is, a manufacturing method of obtaining the spherical toner is not specifically limited.

In the present embodiment, the suspension polymerization method of suspending materials including a monomer, a wax, a charge controlling agent, an initiator and the like in a dispersing medium (ordinarily water) including a dispersing agent, and then producing the toner by the polymerization reaction is used.

Further, in the present embodiment, an external additive other than the charging accelerating particle is added onto the surface of the toner so as to improve toner chargeability and achieve easy control. As the external additive, for example, metal oxide (aluminum oxide, titanium oxide, strontium titanate, magnesium oxide, tin oxide, or the like), carbide (silicon carbide or the like), metal salt (calcium sulfide, barium sulfide, calcium carbonate or the like), fatty-acid metal salt (zinc stearate or the like), carbon black, silica or the like is used. The external additive may be used alone, or the plural external additives may be used together, and in any case, it is desirable to use the additives each subjected to a hydrophobic process.

In the present embodiment, in addition to the charging accelerating particles M, the hydrophobic-processed silica of 2 parts by weight is added to the toner of 100 parts by weight.

(6) Results of Endurance Test

Actually, the image forming operation was performed, and the endurance test was then performed.

An intermittent experimental method of performing printing of 100 sheets, then stopping the apparatus for 30 minutes, and again performing printing of 100 sheets was adopted. It should be noted that this experimental method is severer than an experimental method of continuously printing images, because a startup operation after stopping the apparatus should be frequently performed.

A printing test for 30000 sheets (corresponding to the number of printed copies when the toner in the developing device 4 is exhausted) was performed as variously changing the conditions of the shape factors SF-1 and SF-2 of the toner t as shown in Table 1.

TABLE 1

| | SF-1 | SF-2 | variation co-efficient (%) | weight average particle diam. (μm) | | endurance results |
|---|---|---|---|---|---|---|
| A | 110 | 105 | 30 | 7 | ◎ | no problem |
| B | 120 | 120 | 23 | 7 | ◎ | no problem |
| C | 120 | 140 | 30 | 7 | ○ | no problem little toner on chg. roller at 30000 sht. |
| D | 120 | 150 | 27 | 7 | Δ | fog on drum at about(ab.) 20000 sht. defective chg. at ab. 30000 sht. |
| E | 140 | 120 | 25 | 7 | ◎ | no problem |
| F | 140 | 140 | 30 | 7 | ○ | no problem little toner on chg. roller at 30000 sht. |
| G | 140 | 150 | 25 | 7 | Δ | fog on drum at ab. 15000 sht. defective chg. at ab. 25000 sht. |
| H | 160 | 140 | 25 | 7 | ○ | no problem little toner on chg. roller at 30000 sht. |
| I | 160 | 160 | 30 | 7 | Δ | fog on drum at ab. 10000 sht. defective chg. at ab. 20000 sht. |
| J | 165 | 140 | 25 | 7 | Δ | fog on drum at ab. 15000 sht. defective chg. at ab. 25000 sht. |
| K | 165 | 160 | 27 | 7 | x | fog on drum at ab. 5000 sht. toner fusion at ab. 20000 sht. |
| L | 170 | 175 | 30 | 7 | x | defective chg. and fog on drum at 2000 to 3000 sht. toner fusion and driving stop at ab. 10000 sht. |

In the endurance results of Table 1, symbol ◎ represents the extent that, if the printing of 30000 sheets (sht.) is performed, any problem does not occur on the image and existing of the toner on the charging (chg.) roller can not be recognized by sight, symbol ○ represents the extent that, if the printing of 30000 sheets is performed, any problem does not occur on the image but existing of the toner on the charging roller can be slightly recognized by sight, symbol Δ represents that the problem concerning a defective image such as a fog on the drum, defective charging or the like occurs due to endurance, and symbol×represents that a defect by which the image forming operation can not be performed occurs.

Incidentally, as to the used charging accelerating particles M, the shape factor SF-1' is 170, the shape factor SF-2' is 175, the variation coefficient is 33%, and the weight average particle diameter is 1.5 mm.

In the condition range that SF-1 is 100 to 140 and SF-2 is 100 to 120 (conditions A, B, E), any drawback such as the defective charging, the fog on the drum or the like did not occur if the printing of about 30000 sheets continued, and the high-quality printing could be performed to the last.

In addition, when the state on the charging roller was observed, the sufficient amount of the charging accelerating particles M were held and maintained, and the existing of the toner could not be recognized by sight.

Also, in the condition range that SF-1 is 100 to 160 and SF-2 is 100 to 140 (conditions C, F, H), any drawback such as the defective charging, the fog on the drum or the like did not occur if the printing of about 30000 sheets continued, and the high-quality printing could be performed to the last.

When the state on the charging roller was observed, the sufficient amount of the charging accelerating particles M were held and maintained, and the existing of the toner on the charging roller could be slightly recognized by sight.

On the other hand, in the condition that SF-1 is outside the range of 100 to 160 or SF-2 is outside the range of 100 to 140 (conditions D, G, I, J), the fog on the drum occurred at 10000 to 20000 sheets, and subsequently the defective charging due to the toner clogginess occurred at about 20000 to 30000 sheets.

Further, in the condition that SF-1>160 and SF-2>140 (conditions K, L), the fog on the drum and the defective charging occurred by the printing operation of hundreds sheets, and besides, the toner was fused to the charging roller and the photosensitive drum, and the driving of the charging roller stopped due to the toner clogginess.

As above, the contact developing system capable of performing the developing simultaneous cleaning and the charging system of charging the photosensitive drum 1 through the charging accelerating particles M are used, and also the shape of the developing agent (toner) is made spherical or substantially spherical (the shape factor SF-1 of the developing agent is 100 to 160, the shape factor SF-2 thereof is 100 to 140). Thus, the defective charging and the fog on the drum due to the toner clogginess can be prevented, whereby the ozoneless and cleanerless image forming apparatus capable of performing the image forming without causing any defective image for a long time can be provided.

Second Embodiment

In the second embodiment, an image forming apparatus which can more surely prevent toner clogginess to a charging roller 20 and increase holding force of charging accelerating particles M to the charging roller 20 by increasing sphericity of toner t more than sphericity of the charging accelerating particle M will be explained.

The image forming apparatus in the present embodiment is the same as that shown in FIG. 1, and its structural members are substantially the same as those in the first embodiment, whereby the repetitive detailed explanation thereof will be omitted.

The characteristic point in the present embodiment is to make the toner t spherical more than the charging accelerating particle M, that is, the sphericity of toner t is higher than the sphericity of the charging accelerating particle M.

By increasing the sphericity of toner t more than the sphericity of the charging accelerating particle M, the toner t reached a charging nip a can easily move in the foams of the charging roller 20. Besides, by making the shape of the charging accelerating particle M uneven more than the shape of the toner t, the charging accelerating particles M reached the charging nip a can be made easy to be caught in the foam and by the foam wall of the charging roller. As a result, the charging accelerating particles M necessary and intimately for the charging are easily caught in the foams of the charging roller 20, and at the same time, the toner t is easily pushed out of the foams by elastic deformation of the charging roller 20 and then returned to a developing device 4, whereby it is possible to increase the holding force of the charging accelerating particles M as preventing the toner clogginess in the foams of the charging roller.

Moreover, since the holding force of the charging accelerating particles M is increased, it is possible to decrease an amount of the particles M to be carried from the charging nip a to a photosensitive drum 1. As a result, it is possible to more decrease the danger of exposing troubles due to the charging accelerating particles M. In addition, it is possible to decrease an amount of the charging accelerating particles M mixed in the developing device 4 to be regularly replenished from the developing device 4.

Moreover, in such a style as in the present embodiment that the charging roller 20 is coated with the charging accelerating particles M before the printing operation is performed, since the charging accelerating particles M are caught within the foams of the charging roller 20 before the operation starts, there is also an effect of making uncharged toner and transfer residual toner reached the charging nip a after the operation started difficult to penetrate the foams.

In the present embodiment, it is defined that the sphericity of the toner t is higher than the sphericity of the charging accelerating particle M, if following relations are satisfied.

That is, at least one of following expressions is satisfied:

100≦(SF-1 of toner)

≦(SF-1 of charging accelerating particle); and

100≦(SF-2 of toner)

<(SF-2 of charging accelerating particle)

In addition, it is more desirable to satisfy both the following expressions simultaneously:

100≦(SF-1 of toner)

<(SF-1 of charging accelerating particle); and

100≦(SF-2 of toner)

<(SF-2 of charging accelerating particle)

More preferably, it is desirable to satisfy following expressions:

(SF-2 of toner)/(SF-1 of toner)

<(SF-2 of charging accelerating particle)/(SF-1 of charging accelerating particle); and (SF-2 of toner)/(SF-1 of toner)≦1.0

Since easiness of toner clogginess in the foams is remarkably influenced by the degree of inequality on the toner surface rather than the degree of round of the toner, it is desirable that (SF-2)/(SF-1) of the charging accelerating particle M is higher than (SF-2)/(SF-1) of the toner t.

In the present embodiment, like the first embodiment, toner of which the shape factor SF-1 is 120, the shape factor SF-2 is 120, the weight average particle diameter is 7 mm, and the variation coefficient is 30% is used as the toner t, and zinc oxide particles of which the condition is changed as shown in Table 2 are used as the charging accelerating particles M. The method of calculating the factors SF-1 and SF-2 and the variation coefficient is the same as that in the first embodiment.

TABLE 2

| | SF-1 | SF-2 | variation co-efficient (%) | weight average particle diam. (μm) | applying amount after 30000 sht. printing: chg. acc. particles (/mm²) | applying amount after 30000 sht. printing: toner (/mm²) |
|---|---|---|---|---|---|---|
| A | 110 | 105 | 30 | 1.5 | ab. 20000 | ab. 4000 |
| B | 110 | 130 | 31 | 1.5 | ab. 47000 | ab. 2000 |
| C | 120 | 110 | 29 | 1.5 | ab. 30000 | ab. 3000 |
| D | 120 | 120 | 32 | 1.5 | ab. 35000 | ab. 2500 |
| E | 120 | 130 | 29 | 1.5 | ab. 52000 | ab. 1000 |
| F | 110 | 120 | 32 | 1.5 | ab. 33000 | ab. 2800 |
| G | 130 | 110 | 29 | 1.5 | ab. 45000 | ab. 2000 |
| H | 130 | 120 | 29 | 1.5 | ab. 50000 | ab. 10000 |
| I | 130 | 130 | 32 | 1.5 | ab. 70000 | ab. 800 |
| J | 130 | 140 | 33 | 1.5 | ab. 90000 | ab. 600 |
| K | 140 | 150 | 33 | 1.5 | ab. 120000 | ab. 400 |
| L | 170 | 175 | 35 | 1.5 | ab. 150000 | ab. 200 |

Like the first embodiment, an image forming operation of about 30000 sheets was performed according to a printing method of performing printing of 100 sheets, then stopping the apparatus for 30 minutes, and again performing printing of 100 sheets.

The charging roller 20 had been coated with the charging accelerating (chg. acc.) particles M of a certain amount before the operation of the apparatus started (about 50000 particles/mm$^2$ on the charging roller), and the charging accelerating particles M of 3 parts by weight in the developing device 4 were mixed with the toner of 100 parts by weight.

In the condition that the factors SF-1' and SF-2' of the charging accelerating particles M (weight average particle diameter is about 1.5 mm) are equal to or less than the factors SF-1 and SF-2 of the toner t respectively (i.e., SF-1≧SF-1', and SF-2≧SF-2') (conditions A, C, D, F), the applying amount became less than that of the charging accelerating particles coated on the charging roller before the apparatus started operating.

However, since the applying amount of the charging accelerating particles M necessary to charge the photosensitive drum 1 exists, a problem concerning a defective charging or a fog on the drum did not occur.

Further, in the condition that the factor SF-1' or SF-2' of the charging accelerating particles M is larger than the factor SF-1 or SF-2 of the toner t (i.e., SF-1<SF-1', or SF-2<SF-2') (conditions B, E, G, H), the applying amount of the charging accelerating particles M coated on the charging roller 20 before the apparatus started operating could be maintained.

Furthermore, in the condition that the factors SF-1' and SF-2' of the charging accelerating particles M are larger than the factors SF-1 and SF-2 of the toner t respectively (i.e., SF-1<SF-1', and SF-2<SF-2') (conditions I, J, K, L), the charging accelerating particles M of which the applying amount is equal to or larger than that of the charging accelerating particles M coated on the charging roller 20 before the apparatus started operating could be held and maintained on the charging roller 20, and also the charging accelerating particles M supplied from the developing device 4 when the image was formed could be sufficiently held and maintained on the charging roller 20.

Besides, in this condition, as compared with the other conditions (conditions A to H), the quantity of the toner on the charging roller is very little, whereby it can be understood that there is also an effect of preventing the toner from penetrating the foams based on the charging accelerating particles.

Further, in the condition J, even if the charging accelerating particles of 1 parts by weight were mixed with the toner of 100 parts by weight, the applying amount of the charging accelerating particles M on the charging roller 20 when the printing of 30000 sheets was performed was about 55000 particles/mm$^2$, whereby the high-quality image could be obtained to the last.

Thus, by setting the sphericity of the toner t to be higher than the sphericity of the charging accelerating particle M, it is possible to decrease the ratio of the charging accelerating particles M mixed with the toner t of the developing device 4.

As described above, according to the present embodiment, since the sphericity of the toner is made higher than the sphericity of the charging accelerating particle, the charging accelerating particles necessary and intimately for the charging are easily caught in the foams of the charging roller, and at the same time, the toner is easily pushed out of the foams, whereby it is possible to increase the holding force of the charging accelerating particles as preventing the toner clogginess in the foams of the charging roller.

As a result, it is possible to more decrease the danger of exposing troubles due to the charging accelerating particles. Besides, it is possible to decrease an amount of the charging accelerating particles mixed in the developing device to be regularly replenished from the developing device.

Third Embodiment

In the third embodiment, the structure that a developing device of two-component developing system is used as a developing device 4 will be explained.

Figure 7:
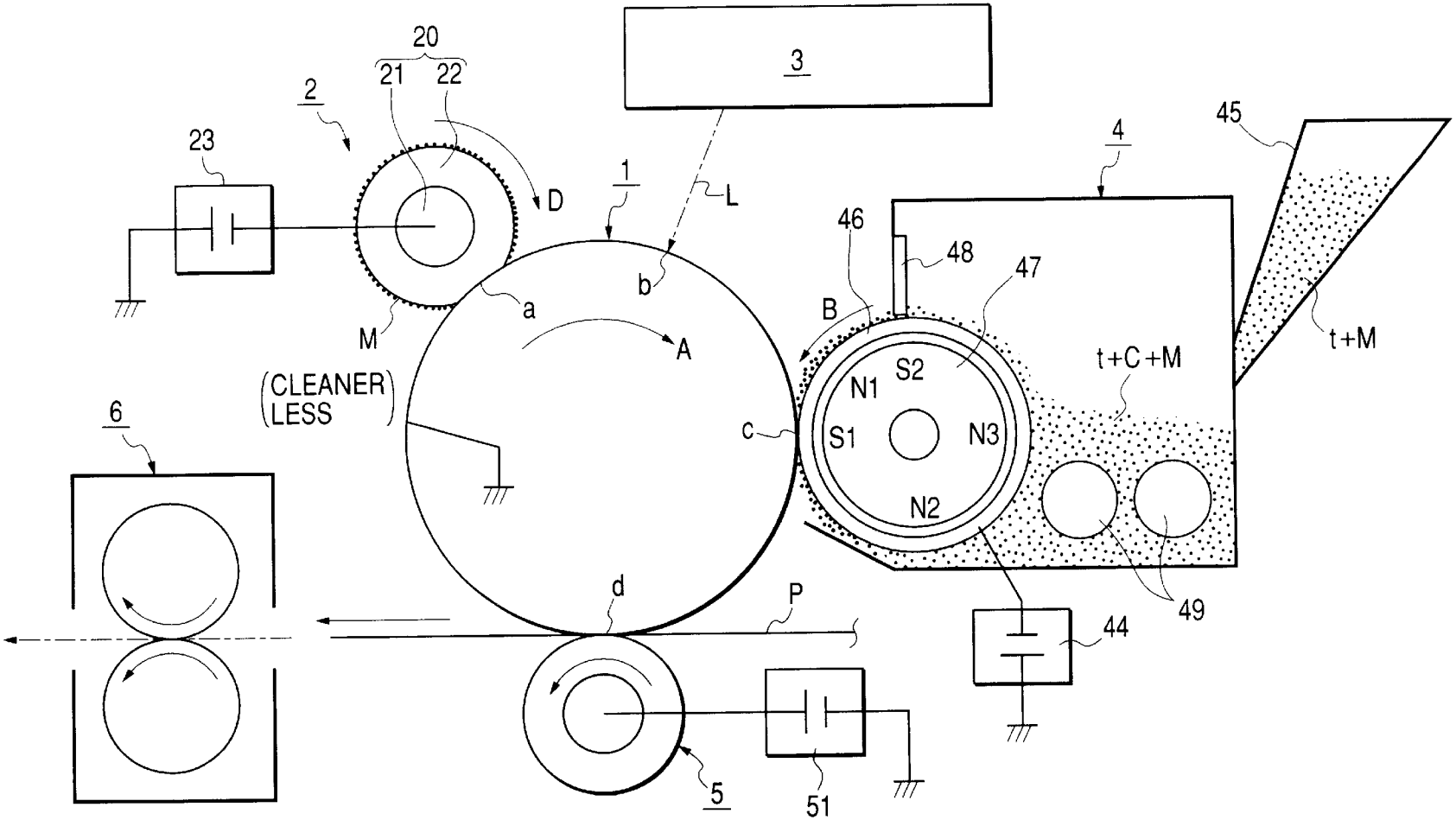
FIG. 7 is a schematic diagram showing an image forming apparatus according to the third embodiment.

An image forming apparatus in the present embodiment is shown in FIG. 7. When comparing this apparatus with the image forming apparatus according to the first embodiment as shown in FIG. 1, the structural members and operations other than the developing device 4 are substantially the same as those in the first embodiment, whereby the repetitive detailed explanation thereof will be omitted.

The developing device 4 which is the developing device of two-component developing system contains a two-component developing agent obtained by mixing toner t with magnetic carrier particles C made by ferrite of particle diameter 40 mm, and charging accelerating particles M.

The toner t is the same spherical toner as that used in the first embodiment, and the charging accelerating particle M is the same as that (SF-1' is 170, SF-2' is 175, the variation coefficient is 33%, and the weight average particle diameter is 1.5 mm) used in the first embodiment. A mixing ratio of the toner t and the carrier particles C is adjusted such that it becomes the toner 5 parts by weight for the carrier particles 100 parts by weight.

If it is detected by a not-shown toner density sensor that the toner ratio in the developing device 4 decreases, the mixture of the toner t and the charging accelerating particles M is supplied from a hopper 45 into the developing device 4.

A developing agent bearing body has a developing sleeve 46 of which the diameter is 16 mm and a magnet roller 47 which is fixedly disposed in the developing sleeve 46, and a regulating blade 48 which is used to regulate the thickness of the developing agent layer on the surface of the developing sleeve 46 is disposed so that the closest distance between the blade 48 and the sleeve 46 is about 400 mm. Moreover, the developing sleeve 46 is disposed so that the closest distance between the sleeve 46 and a photosensitive drum 1 is about 400 mm, and it is set that the developing agent layer bore on the surface of the developing sleeve 46 is in contact with the photosensitive drum 1 by the width of about 3 mm. The rotational direction of the developing sleeve 46, i.e., the moving direction of the surface of the sleeve 46, is the same as the moving direction of the surface of the photosensitive drum 1 at the portion facing the drum 1, and the rotational speed of the sleeve 46 is 150% of the circular speed of the drum 1. That is, the developing sleeve 46 rotates at a circular speed 150 mm/s. A DC voltage of −350V is applied to the developing sleeve 46 by a developing bias power supply 44.

In the developing device 4, the toner t, the carrier particles C and the charging accelerating particles M are mixed by agitating/carrying screws 49, the toner t is charged to negative polarity, the charging accelerating particles M are charged to weak positive polarity, and the carrier particles C are charged to positive polarity.

The carrier particles C to which the toner t and the charging accelerating particles M have adhered constitute a magnetic brush by magnetic force of the magnet roller 47, and the magnetic brush passes the position of the regulating blade 48 according to the rotation of the developing sleeve 46. At the same time as passing, the height of so-called scopulas of the magnetic brush on the developing sleeve 46 is regulated. Then, the magnetic brush is conveyed to a developing nip c by the rotation of the developing sleeve 46 and comes into contact with the photosensitive drum 1. Since the carrier particles C are caught by the magnetic force of the magnet roller 47 in the developing nip c, the toner t adheres to the photosensitive drum 1 if a latent image exists on the drum 1 (image portion), while the charging accelerating particles M are supplied to the photosensitive drum 1 if any latent image does not exist (non-image portion).

The following action of the toner t and the charging accelerating particles M thus supplied to the photosensitive drum 1 is the same as that in the first embodiment, a problem concerning toner clogginess in the foams of the charging roller or a fog on the drum does not occur, whereby a steady image forming operation can be performed.

Further, if the two-component developing system is adopted, the toner on the photosensitive drum after passing the charging nip a can be electrically retrieved, and also a mechanical scraping effect by the magnetic brush can be obtained in the developing nip c, whereby it is possible to more surely perform developing simultaneous cleaning.

Based on the structure of the present embodiment, the image forming operation was performed actually. An intermittent experimental method of performing printing of 100 sheets, then stopping the apparatus for 30 minutes, and again performing printing of 100 sheets was adopted. It should be noted that this experimental method is severer than an experimental method of continuously printing images, because a startup operation after stopping the apparatus should be frequently performed.

A printing test for 30000 sheets (corresponding to the number of printed copies when the toner in the developing device is exhausted) was performed as variously changing, like the first embodiment, the conditions of the shape factors SF-1 and SF-2 of the toner as shown in Table 3.

TABLE 3

| | SF-1 | SF-2 | variation co-efficient (%) | weight average particle diam. (μm) | | endurance results |
|---|---|---|---|---|---|---|
| A | 110 | 105 | 30 | 7 | ◎ | no problem |
| B | 120 | 120 | 23 | 7 | ◎ | no problem |
| C | 120 | 140 | 30 | 7 | ○ | no problem little toner on chg. roller at 30000 sht. |
| D | 120 | 150 | 27 | 7 | Δ | fog on drum at ab. 30000 sht. |
| E | 140 | 120 | 25 | 7 | ◎ | no problem |
| F | 140 | 140 | 30 | 7 | ○ | no problem little toner on chg. roller at 30000 sht. |
| G | 140 | 150 | 25 | 7 | Δ | fog on drum at ab. 20000 sht. defective chg. at ab. 28000 sht. |
| H | 160 | 140 | 25 | 7 | ○ | no problem little toner on chg. roller at 30000 sht. |
| I | 160 | 160 | 30 | 7 | Δ | fog on drum at ab. 15000 sht. defective chg. at ab. 25000 sht. |
| J | 165 | 140 | 25 | 7 | Δ | fog on drum at ab. 20000 sht. defective chg. at ab. 29000 sht. |
| K | 165 | 160 | 27 | 7 | x | fog on drum at ab. 9000 sht. toner fusion at ab. 23000 sht. |
| L | 170 | 175 | 30 | 7 | x | defective chg. and fog on drum at 4000 to 5000 sht. toner fusion and driving stop at |

In the endurance results of Table 3, symbol ◎ represents the extent that, if the printing of 30000 sheets is performed, any problem does not occur on the image and existing of the toner on the charging roller can not be recognized by sight, symbol ○ represents the extent that, if the printing of 30000 sheets is performed, any problem does not occur on the image but existing of the toner on the charging roller can be slightly recognized by sight, symbol Δ represents that the problem concerning a defective image such as a fog on the drum, defective charging or the like occurs due to endurance, and symbol× represents that a defect by which the image forming operation can not be performed occurs.

In the condition range that SF-1 is 100 to 140 and SF-2 is 100 to 120 (conditions A, B, E), any drawback such as the defective charging, the fog on the drum or the like did not occur if the printing of about 30000 sheets continued, and the high-quality printing could be performed to the last.

In addition, when the state on the charging roller 20 was observed, the sufficient amount of the charging accelerating particles M were held and maintained, and the existing of the toner could not be recognized by sight.

Also, in the condition range that SF-1 is 100 to 160 and SF-2 is 100 to 140 (conditions C, F, H), any drawback such as the defective charging, the fog on the drum or the like did not occur if the printing of about 30000 sheets continued, and the high-quality printing could be performed to the last.

When the state on the charging roller 20 was observed, the sufficient amount of the charging accelerating particles M were held and maintained, and the existing of the toner t could be slightly recognized by sight.

On the other hand, in the condition that SF-1 is outside the range of 100 to 160 or SF-2 is outside the range of 100 to 140 (conditions D, G, I, J), the fog on the drum occurred while the printing operation is being performed, and subsequently the defective charging due to the toner clogginess occurred.

Further, in the condition that SF-1>160 and SF-2>140 (conditions K, L), the fog on the drum and the defective charging occurred, and besides, the toner was fused to the charging roller 20 and the photosensitive drum 1, and the driving of the charging roller 20 stopped due to the toner clogginess.

By adopting the cleanerless structure of two-component contact developing system as above, the defective charging and the fog on the drum due to the toner clogginess of the charging roller 20 can be prevented, whereby the ozoneless and cleanerless image forming apparatus capable of performing high-quality image forming without causing any defective image for a long time can be provided.

Other Embodiments

1) Although the image forming apparatus in each of the above embodiments adopts the form of supplying the charging accelerating particles M from the developing device 4, the present invention is not limited to this form. For example, the effect of the present invention is unaffected by a method of causing a supplying member obtained by making the charging accelerating particles M blockish to come into contact with the charging roller 20 and thus scraping the particles from this block little by little by the rotation of the charging roller 20.

2) Further, although the reversal contact developing system of negative polarity is explained by way of example as the developing device 4 of the image forming apparatus in each of the above embodiments, the same effect as above can be obtained in an image forming apparatus which adopts a reversal developing system of positive polarity.

3) The exposing device as the optical image exposing means is not limited to the laser scanner (digital exposing device) as in the embodiments, that is, a device capable of writing an electrostatic latent image corresponding to image information may be used. As such the devices, an original image projecting imaging optical system (analog exposing device), a combination of a light source such as a light emitting array (LED, etc.), a fluorescent lamp or the like and a liquid crystal shutter or the like, and the like can be used.

4) The image bearing body may be an electrostatic recording dielectric or the like. In this case, after the surface of the dielectric was uniformly primary-charged to predetermined polarity and potential, the charge on the surface is selectively removed to write and form the electrostatic latent image.

As expatiated above, in the image forming apparatus of direct charging system and contact developing system which performs the charging through the charging accelerating particles, since the developing agent (toner) is made spherical, the defective charging and the fog on the drum due to the toner clogginess in the charging member can be prevented. Moreover, since the sphericity of the developing agent is made higher than the sphericity of the charging accelerating particle, the catching and holding force for the charging accelerating particles of the charging member can be improved, and at the same time, the defective charging and the fog on the drum due to the toner clogginess in the charging member can be prevented.

As a result, the cleanerless and ozoneless image forming apparatus capable of performing high-quality image forming for a long time can be provided.

By making the developing agent (toner) spherical or substantially spherical, the reversal toner and the uncharged toner on the image bearing body are uniformly mixed with the charging accelerating particles as rotating with the speed difference in the contact portion between the image bearing body and the charging member, and the surface of the toner is uniformly friction-charged, whereby the toner can be normally charged completely. As a result, since the toner can be retrieved by the developing device, the fog on the drum can be prevented.

Further, in the case where the charging member is structured by the foamed elastic body having the foams so that the charging accelerating particles can be easily caught and held on the surface of the charging member, the reversal toner and the uncharged toner on the image bearing body penetrate the foams in the contact portion between the image bearing body and the charging member. However, by making the developing agent spherical or substantially spherical, the penetrated toner is easily pushed out of the foams by the elastic deformation of the charging member, whereby the toner clogginess, the defective charging due to the toner clogginess, increase of the hardness of the charging roller, and the toner fusion to the respective members can be prevented.

In addition, by making the average foam diameter of the foamed elastic body three times or more the average particle diameter of the toner, the toner smoothly moves and rotates in the foams, the toner is easily pushed out of the foams by the elastic deformation of the charging member without any toner packing in the foams.

Further, by making the sphericity of the toner higher than the sphericity of the charging accelerating particle, the charging accelerating particles can be made easy to be caught and maintained by the charging member, and further the toner can be made difficult to be caught and maintained by the charging member, whereby the toner clogginess and the defective charging due to the toner clogginess can be more surely prevented.

Further, by making the arrangement so that the developing member bumps against the image bearing body or comes into contact with the image bearing body through the developing agent layer, the intensity of the electric field formed between the image bearing body and the developing member can be increased, whereby the toner normally charged in the contact portion between the image bearing body and the charging member can be surely retrieved by the developing member.

As described above, the present invention is not limited to the above embodiments, and various modifications are possible within the technical idea of the present invention.

What is claimed is:

1. An image forming apparatus comprising:

an image bearing body;

a flexible charging member constituting a nip portion together with said image bearing body, said nip portion being provided with conductive particles;

a source for supplying said flexible charging member with a voltage of predetermined polarity to charge said image bearing body; and a developing member for developing an electrostatic image formed on said image bearing body, with use of a developing agent, wherein said developing agent has substantially spherical toner, such that residual spherical toner conveyed to said flexible charging member is chargeable by friction with the conductive particles to the same polarity as the predetermined polarity.

2. An image forming apparatus according to claim 1, wherein said developing member is capable of retrieving residual toner on said image bearing body.

3. An image forming apparatus according to claim 1, wherein said developing member is a developing agent bearing body for bearing the developing agent, and said developing agent bearing body is provided to come into contact with said image bearing body.

4. An image forming apparatus according to claim 1, wherein a shape factor SF-1 of the toner is 100 to 160, and a shape factor SF-2 of the toner is 100 to 140.

5. An image forming apparatus according to claim 1, wherein relation between shape factors SF-1 and SF-2 of the toner is (SF-2)/(SF-1)≦1.0.

6. An image forming apparatus according to claim 1, wherein said charging member has an elastic body having inequalities on a surface thereof.

7. An image forming apparatus according to claim 1, wherein said charging member has a foamed elastic body on a surface thereof.

8. An image forming apparatus according to claim 7, wherein an average foam diameter on the surface of said foamed elastic body is three times or more an average particle diameter of the toner.

9. An image forming apparatus according to claim 1, wherein said charging member is moved so that said charging member and said image bearing body has a difference in circular speed.

10. An image forming apparatus according to claim 1, wherein a shape factor SF-1 of the toner and a shape factor SF-1' of the conductive particle satisfy a following expression:

$$100 \leqq SF\text{-}1 < SF\text{-}1'.$$

11. An image forming apparatus according to claim 1, wherein a shape factor SF-2 of the toner and a shape factor SF-2' of the conductive particle satisfy a following expression:

$$100 \leqq SF\text{-}2 < SF\text{-}2'.$$

12. An image forming apparatus according to claim 1, wherein shape factors SF-1 and SF-2 of the toner and shape factors SF-1' and SF-2' of the conductive particle satisfy following expressions:

$$100 \leqq SF\text{-}1 < SF\text{-}1'; \text{ and}$$

$$100 \leqq SF\text{-}2 < SF\text{-}2'.$$

13. An image forming apparatus according to claim 1, wherein shape factors SF-1 and SF-2 of the toner and shape factors SF-1' and SF-2' of the conductive particle satisfy a following expression:

$$(SF\text{-}2)/(SF\text{-}1) < (SF\text{-}2')/(SF\text{-}1').$$

14. An image forming apparatus according to claim 1, wherein the conductive particles are supplied from said developing member to said image bearing body, and bore to said nip portion by said image bearing body.

15. An image forming apparatus according to claim 1, further comprising transferring means for transferring a toner image formed on said image bearing body by said developing member, to a recording medium.

16. An image forming apparatus according to claim 1, wherein said charging member is a charging roller.

17. An image forming apparatus according to claim 1, wherein a rotating direction of said charging member at said nip portion is opposite to a rotating direction of said image bearing body.

* * * * *

UNITED STATES PATENT AND TRADEMARK OFFICE

CERTIFICATE OF CORRECTION

PATENT NO. : 6,647,229 B2
DATED : November 11, 2003
INVENTOR(S) : Manami Haraguchi et al.

It is certified that error appears in the above-identified patent and that said Letters Patent is hereby corrected as shown below:

Title page,
Item [56], References Cited, FOREIGN PATENT DOCUMENTS,
"10/307554" should read -- 10-307455 --; and "10/307459" should read -- 10-307459 --.

Column 6,
Lines 16, 21 and 36, "if" should read -- 1*f* --.

Column 19,
Line 41, "≦(SF-1" should read -- < (SF-1 --.

Signed and Sealed this

Twenty-seventh Day of April, 2004

JON W. DUDAS
*Acting Director of the United States Patent and Trademark Office*